US005114505A

United States Patent [19]

Mirchandani et al.

[11] Patent Number: 5,114,505

[45] Date of Patent: May 19, 1992

[54] ALUMINUM-BASE COMPOSITE ALLOY

[75] Inventors: Prakash K. Mirchandani, Troy, Mich.; Raymond C. Benn, Madison, Conn.; Walter E. Mattson, Huntington, W. Va.

[73] Assignee: Inco Alloys International, Inc., Huntington, W. Va.

[21] Appl. No.: 574,903

[22] Filed: Aug. 30, 1990

Related U.S. Application Data

[63] Continuation-in-part of Ser. No. 432,124, Nov. 6, 1989, abandoned.

[51] Int. Cl.[5] ..... C22C 21/00; B22F 9/00

[52] U.S. Cl. ..... 148/437; 75/235; 75/238; 75/249; 148/438; 148/439; 148/440; 420/528

[58] Field of Search ..... 148/437, 438, 439, 440, 148/126.1; 420/528; 75/249, 235, 238

[56] References Cited

U.S. PATENT DOCUMENTS

| | | | |
|---|---|---|---|
| 4,134,759 | 1/1979 | Yajima et al. | 75/204 |
| 4,557,893 | 12/1985 | Jatkar et al. | 419/12 |
| 4,600,556 | 7/1986 | Donachie et al. | 420/542 |
| 4,623,388 | 11/1986 | Jatkar et al. | 75/232 |
| 4,624,705 | 11/1986 | Jatkar et al. | 75/239 |
| 4,832,734 | 5/1989 | Benn et al. | 75/249 |
| 4,834,810 | 5/1989 | Benn et al. | 148/437 |
| 4,933,007 | 6/1990 | Miura et al. | 75/235 |

FOREIGN PATENT DOCUMENTS

| | | | |
|---|---|---|---|
| 332430 | 9/1989 | European Pat. Off. | 148/437 |

OTHER PUBLICATIONS

*Casting*–metals Handbook Ninth Edition, vol. 15 ASM International handbook Committee, pp. 95–107 & pp. 840–854.

*Metallography, Structure and Phase Diagrams,* Metals Handbook, Eighth Edition, vol. 8, ASM International Handbook Committee, pp. 242–245.

*Pearson's Handbook of Crystallographic Data for Intermetallic Phases* by P. Villars & L. D. Calvert / pp. 1075–1076 American Society for Metals.

*New Materials by Mechanical Alloying Techniques,* By: E. Arzt and L. Schultz copyright 1989 by Deutsche Gesellschaft fur Metal kunde e.V. (pp. 19–38).

*Primary Examiner*—Richard O. Dean
*Assistant Examiner*—Robert R. Koehler
*Attorney, Agent, or Firm*—Blake T. Biederman; Francis J. Mulligan, Jr.; Edward A. Steen

[57] ABSTRACT

A composite aluminum-base alloy having a mechanically alloyed matrix alloy. The matrix alloy has about 4–40 percent by volume aluminum-containing intermetallic phase. The aluminum-containing intermetallic phase includes at least one element selected from the group consisting of niobium, titanium and zirconium. The intermetallic phase is essentially insoluble in the matrix alloy below one half of the solidus temperature of the matrix alloy. The balance of the matrix alloy is principally aluminum. A stiffener of 5 to 30 percent by volume of the composite aluminum-base alloy is dispersed within the metal matrix.

13 Claims, 1 Drawing Sheet

ALUMINUM-BASE COMPOSITE ALLOY

This is a continuation-in-part of application Ser. No. 432,124, filed on Nov. 6, 1989, now abandoned.

This invention relates to composite aluminum-base alloys. More particularly, this invention relates to composite aluminum-base alloys with useful engineering properties at relatively high temperatures.

BACKGROUND OF THE INVENTION AND PROBLEM

Composite structures have become a practical solution to developing materials with specialized properties for specific applications. Metal matrix composites have become especially useful in specific aeronautical applications. Composite materials combine features of at least two different materials to arrive at a material with desired properties. For purposes of this specification, a composite is defined as a material made of two or more components having at least one characteristic reflective of each component. A composite is distinguished from a dispersion strengthened material in that a composite has particles in the form of an aggregate structure with grains, whereas, a dispersion has fine particles distributed within a grain. Dispersoids strengthen a metal by increasing the force necessary to move a dislocation around or through dispersoids. Experimental testing of dispersion strengthened metals has resulted in a number of models for explaining the strength mechanism of dispersion strengthened metals. The stress required of the Orowan mechanism wherein dislocations bow around dispersoids leaving a dislocation loop surrounding the particle is given by:

$$\sigma_{or} = \frac{0.8\ GbM}{L}$$

where $\sigma_{or}$ is the stress of a dislocation to bow around a dislocation with the Orowan mechanism, G is the shear modulus, b is the Burgers vector, M is the Taylor factor and L is the interdispersoid distance. The appropriate interdispersoid distance is the mean square lattice spacing which is calculated by the following equation:

$$L=[(\pi/f)^{0.5}-2](2/3)^{0.5}r$$

where f is the volume fraction of dispersoid and r is the dispersoid radius. Dispersoids with an interparticle distance of much more than 100 nm will not significantly increase yield strength. Optimum dispersion strengthening is achieved with, for example, 0.002–0.10 volume fraction dispersoids having a diameter between 10 and 50 nm. Decreasing interdispersoid spacing is a more effective means of increasing dispersion strengthening than increasing volume fraction because of the square root dependence of volume fraction in the above equation.

A major factor in producing metal matrix composites is compatibility between dispersion strengtheners and the metal matrix. Poor bonding between the matrix and the strengtheners significantly diminishes composite properties. A composite structure has properties that are a compromise between the properties of two or more different materials. Room temperature ductility generally decreases proportionally and stiffness increases proportionally with increased volume fraction of particle stiffener (hard phase) within a metal matrix. Conventional aluminum SiC composites have been developed as high modulus lightweight materials, but these composites typically do not exhibit useful strength or creep resistance at temperatures above about 200° C.

A mechanically alloyed composite of aluminum matrix with SiC particles is disclosed in U.S. Pat. No. 4,623,388. However, these alloys lose properties at elevated temperatures.

A high modulus mechanically alloyed aluminum-base alloy is disclosed in U.S. Pat. No. 4,834,810. The aluminum matrix of this invention is strengthened with $Al_3Ti$ intermetallic phase, $Al_2O_3$ and $Al_4C_3$ formed from stearic acid and/or graphite process control agents. The fine particle dispersion strengthening mechanism of the '810 patent produced an alloy having high modulus and relatively high temperature performance.

It is an object of this invention to produce an aluminum-base metal matrix composite having sufficient bonding between the metal matrix and particle stiffeners.

It is another object of this invention to produce a mechanically alloyed aluminum-base alloy having increased retained ductility upon addition of stiffener particles.

It is another object of this invention to produce a lightweight aluminum-base alloy having practical engineering properties at higher temperatures.

SUMMARY OF THE INVENTION

The invention provides a composite aluminum-base alloy. The composite alloy has a mechanically alloyed matrix alloy. The matrix alloy has at least about 4–45 volume percent aluminum-containing intermetallic phase. The aluminum-base forms an intermetallic phase with at least one element selected from the group consisting of niobium, titanium and zirconium. The element is combined with the matrix alloy as an intermetallic phase. The intermetallic phase is essentially insoluble in the matrix alloy below one half of the solidus temperature of the matrix alloy. The balance of the matrix alloy is principally aluminum. A stiffener is dispersed within the matrix alloy. The stiffener occupies from about 5–30 percent by volume of the composite aluminum-base alloy.

DESCRIPTION OF PREFERRED EMBODIMENT

Figure 1:
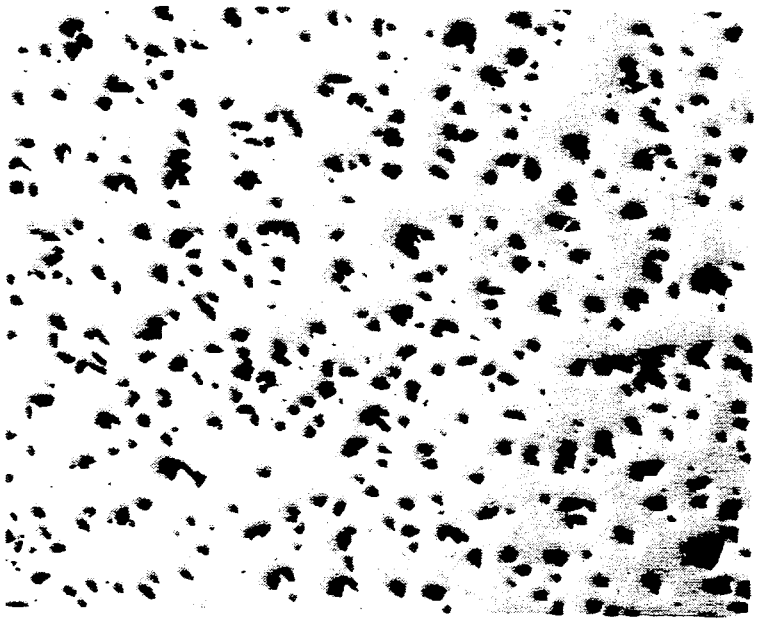
FIG. 1 is a photomicrograph of mechanically alloyed Al-13 v/o $Al_3Ti$ - 5 v/o SiC particles magnified 200 times.

The composite of the invention combines a stiff, but surprisingly ductile metal matrix with a stiffener. The metal matrix is produced by mechanically alloying aluminum with one or more transition or refractory metals. The metal matrix powder is made by mechanically alloying elemental or intermetallic ingredients as previously described in U.S. Pat. Nos. 3,740,210, 4,600,556, 4,623,388, 4,624,705, 4,643,780, 4,668,470, 4,627,959, 4,668,282, 4,557,893 and 4,834,810. In mechanically alloying ingredients to form the alloys, process control aids such as stearic acid, graphite or a mixture of stearic acid and graphite are used. Preferably, stearic acid is used.

The metal matrix is an aluminum-base mechanically alloyed metal preferably containing at least one element selected from the group consisting of niobium, titanium and zirconium. The element or elements is or are combined with the matrix metal as an intermetallic phase or phases. The intermetallic phase is essentially insoluble below one half the solidus temperature (in an absolute temperature scale such as degree Kelvin) of the matrix and are composed of elements that have low diffusion rates at elevated temperatures. A minimum of about 4 or 5 volume percent aluminum-containing intermetallic phase provides stability of the composite structure at relatively high temperatures. Greater than 40 volume percent aluminum-containing intermetallic phase is detrimental to ductility of the final composite and its metal matrix.

The balance of the matrix alloy is essentially aluminum. Additionally, the metal matrix may contain about 0-2 percent oxygen and about 0-4 percent carbon by weight. These elements form into the metal matrix from the break down of process control agents, exposure to air and inclusion of impurities. Stearic acid breaks down into oxygen which forms fine particle dispersion of $Al_2O_3$, carbon which forms fine particle dispersions of $Al_4C_3$ and hydrogen which is released. These dispersions typically originate from process control agents such as stearic acid and to a lesser extent from impurities. $Al_2O_3$ and $Al_4C_3$ dispersions are preferably limited to a level which provides sufficient matrix ductility.

It is preferred that intermetallics compounds be formed with Nb, Ti and Zr. Table 1 below contains a calculated conversion of volume percent $Al_3X$ to weight percent Ti, Zr, Nb and a calculated conversion of weight percent X to volume percent $Al_3Nb$, $Al_3Ti$ and $Al_3Zr$. Furthermore, the present invention contemplates any range definable by any two specific values of Table 1 and any range definable between any specified values of Table 1. For example, the invention contemplates 5-15 volume percent $Al_3Nb$ and 7.5-17 weight percent Nb.

TABLE 1

| | VOLUME % $Al_3X$ | | | | | | |
|---|---|---|---|---|---|---|---|
| | 4 v/o | 5 v/o | 10 v/o | 15 v/o | 25 v/o | 35 v/o | 40 v/o |
| wt % Nb | 3.4 | 4.3 | 8.6 | 13 | 22 | 30 | 34 |
| wt % Ti | 1.8 | 2.3 | 4.5 | 6.8 | 11 | 16 | 18 |
| wt % Zr | 3.1 | 3.9 | 7.8 | 12 | 20 | 27 | 31 |
| | Wt % X | | | | | | |
| | 2% | 4% | 5% | 8% | 10% | 15% | 20% |
| v/o $Al_3Nb$ | 2.3 | 4.6 | 5.8 | 9.3 | 12 | 17 | 23 |
| v/o $Al_3Ti$ | 4.4 | 8.8 | 11 | 18 | 22 | 33 | 44 |
| v/o $Al_3Zr$ | 2.6 | 5.1 | 6.4 | 10 | 13 | 19 | 26 |

As illustrated in Table 1, Ti by weight produces about twice as much intermetallic. For example, to form 10 v/o $Al_3X$ only about 4.5 wt % Ti is required compared to 7.8 wt % Zr and 8.6 wt % Nb respectively. To provide an equal volume percent of intermetallic strengthener, Zr and Nb increase density much greater than Ti. $Al_3Ti$ tends to form a different morphological structure in MA aluminum-base alloys than the structure formed by $Al_3Nb$ and $Al_3Zr$. Particles of $Al_3Ti$ having the approximate size of an aluminum grain are formed by Ti. Dispersoids of $Al_3Nb$ and $Al_3Zr$ distributed throughout a grain are formed by Nb and Zr respectively. The relatively large intermetallic $Al_3Ti$ grains provide strengthening at increased temperatures. It is believed $Al_3Nb$ and $Al_3Zr$ dispersions provide Orowan strengthening at room to moderate temperature, but decrease ductility at elevated temperatures. Thus, $Al_3Ti$ is advantageous, since Ti forms an equal volume of $Al_3X$ intermetallic with a lower weight percent than Nb or Zr, and $Al_3Ti$ strengthens more effectively at elevated temperatures than $Al_3Nb$ and $Al_3Zr$. In addition, a combination of titanium and niobium or zirconium may be used to provide strengthening from a combination of $Al_3X$ strengthening mechanisms. It has been found that metal matrix compositions having between 4 and 40 percent by volume $Al_3Ti$ are especially useful engineering materials. More particularly, metal matrix composites having between 18 to 40 volume percent $Al_3Ti$ combined with a hard phase stiffener provide alloys with high stiffness, good wear resistance, low densities and low coefficients of thermal expansion. These properties are useful for articles of manufacture and especially useful for aeronautical and other applications which require strength at temperatures between about 200° C. and 500° C., such as engine parts. Metal matrix composites having 4 or 5 to 18 volume percent $Al_3Ti$ are especially useful for alloys requiring high ductility and strength.

The matrix of the invention is strengthened with 5-30 percent by volume stiffener. Stiffeners in the form of both particles and whiskers or fibers may be mixed into the matrix powder. The metal matrix of the invention has been discovered to have exceptional retained ductility after addition of particle stiffeners. For this reason, the stiffener may be any known stiffener such as $Al_2O_3$, Be, BeO, $B_4C$, BN, C, MgO, SiC, $Si_3N$, $TiB_2$, TiC, TiN, W, WC, $Y_2O_3$, $ZrB_2$, ZrC and $ZrO_2$. Whiskers or fibers are preferred for parts which utilize an anisotropic properties. Whereas, particle stiffeners are preferred for parts requiring more isotropic properties.

Composite alloy powders were prepared by adding an additional step to the processing of mechanically alloyed powder. The extra step consisted of dry blending the desired volume fraction of SiC particle stiffener with the mechanically alloyed matrix powder in a V-blender for two hours. Alternatively, the stiffener particles may be mechanically alloyed directly with the metal matrix material. The blend of SiC particles and mechanically alloyed metal matrix powder was then degassed, consolidated and extruded. The alloys were extruded at 427° C. (800° F.).

Figure 2:
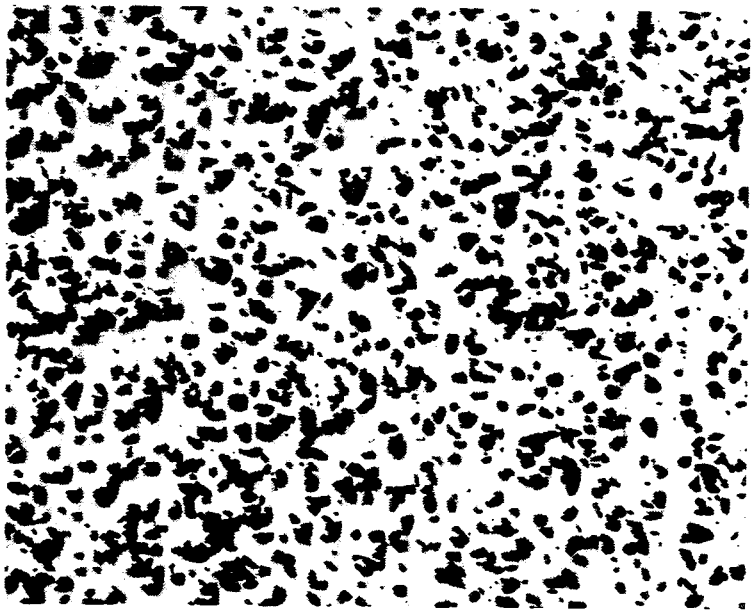
FIG. 2 is a photomicrograph of mechanically alloyed Al-13 v/o $Al_3Ti$ - 15 v/o SiC particles magnified 200 times.

The average particle size of silicon carbide utilized was approximately 8-9 micrometers. More specifically, SiC particles utilized were 800 mesh (19 micron) particles produced by the Norton Company. The 800 mesh SiC particles were not as hygroscopic as finer 1,000 or 1,200 mesh powders (15 or 12 micron). The finer particles had a tendency to attach and clump to each other, lowering the uniformity of SiC powder distribution. In addition, it was found that finer particles were inherently more difficult to distribute uniformly. It has been found that stiffener particles which are on average greater than about 0.5-0.6 times by volume than those of the matrix powders provide highly uniform blending regardless of whether blending operations are wet or dry. In general, particles utilized will be greater than 1 micrometer in diameter to provide an aggregate structure with composite type properties. This uniformity of SiC particle distribution is illustrated in FIGS. 1 and 2.

Three different metal matrix compositions Al-0 wt % Ti, Al-6 wt % Ti and Al-10 wt % Ti (0 v/o $Al_3Ti$, 13 v/o $Al_3Ti$ and 22 v/o $Al_3Ti$) were all tested with 0, 5 and 15 volume percent silicon carbide particles added. The composites were all extruded as 0.5 in.×2.0 in.×5 ft. (1.27 cm×5.08 cm×1.52 m) bars. All matrix mechanically alloyed powders were prepared using 2.5 wt % stearic acid. Other process control agents may also be effective. All samples were tested in accordance with ASTM E8 and E21, measuring ultimate tensile strength, yield strength, elongation and reduction in area. The results are summarized below in Table 2, Table 3 and Table 4 as follows:

TABLE 2

| Alloy/ Composite | Test Temperature (°C.) | Ultimate Tensile Strength (MPa) | Yield Strength (MPa) | Elongation (%) | Reduction in Area (%) |
|---|---|---|---|---|---|
| MA Al-0 wt % Ti | 24 | 421 | 374 | 19.0 | 54.4 |
| | 93 | 354 | 345 | 11.0 | 44.4 |
| | 204 | 292 | 270 | 10.0 | 30.2 |
| | 316 | 197 | 193 | 6.0 | 16.5 |
| | 427 | 110 | 107 | 1.0 | 3.2 |
| | 538 | 59 | 59 | 1.0 | 3.6 |
| MA Al-0 wt % Ti-5 v/o SiC | 24 | 457 | 404 | 7.0 | 13.1 |
| | 93 | 407 | 363 | 3.0 | 16.0 |
| | 204 | 336 | 316 | 4.0 | 10.1 |
| | 316 | 198 | 194 | 5.0 | 13.9 |
| | 427 | 123 | 119 | 2.0 | 1.6 |
| | 538 | 54 | 53 | 1.0 | 1.6 |
| MA Al-0 wt % Ti-15 v/o SiC | 24 | 456 | 405 | 5.0 | 8.6 |
| | 93 | 398 | 366 | 4.0 | 7.0 |
| | 204 | 325 | 298 | 1.0 | 4.0 |
| | 316 | 183 | 174 | 4.0 | 9.3 |
| | 427 | 103 | 93 | 4.0 | 18.9 |
| | 538 | 56 | 56 | 3.0 | 7.8 |

TABLE 3

| Alloy/ Composite | Test Temperature (°C.) | Ultimate Tensile Strength (MPa) | Yield Strength (MPa) | Elongation (%) | Reduction in Area (%) |
|---|---|---|---|---|---|
| MA Al-6 wt % Ti | 24 | 523 | 450 | 13.0 | 28.0 |
| | 93 | 431 | 410 | 5.0 | 13.1 |
| | 204 | 324 | 305 | 8.0 | 11.0 |
| | 316 | 205 | 198 | 7.0 | 22.3 |
| | 427 | 132 | 125 | 8.0 | 25.3 |
| | 538 | 66 | 64 | 10.0 | 18.0 |
| MA Al-6 wt % Ti-5 v/o SiC | 24 | 547 | 510 | 3.0 | 8.6 |
| | 93 | 484 | 450 | 2.0 | 9.3 |
| | 204 | 403 | 377 | 1.0 | 4.8 |
| | 316 | 215 | 210 | 5.0 | 9.3 |
| | 427 | 149 | 145 | 5.0 | 16.7 |
| | 538 | 74 | 71 | 12.0 | 22.0 |
| MA Al-6 wt % Ti-15 v/o SiC | 24 | 555 | 515 | 2.0 | 3.8 |
| | 93 | 500 | 459 | 3.0 | 3.1 |
| | 204 | 397 | 348 | 2.0 | 6.8 |
| | 316 | 207 | 205 | 2.0 | 7.0 |
| | 427 | 129 | 128 | 4.0 | 18.7 |
| | 538 | 73 | 70 | 5.0 | 14.5 |

TABLE 4

| Alloy/ Composite | Test Temperature (°C.) | Ultimate Tensile Strength (MPa) | Yield Strength (MPa) | Elongation (%) | Reduction in Area (%) |
|---|---|---|---|---|---|
| MA Al-10 wt % Ti | 24 | 534 | 458 | 13.0 | 10.9 |
| | 93 | 449 | 420 | 11.0 | 12.4 |
| | 204 | 365 | 338 | 6.0 | 9.5 |
| | 316 | 238 | 234 | 4.0 | 11.1 |
| | 427 | 136 | 132 | 8.0 | 13.5 |
| | 538 | 70 | 66 | 11.0 | 18.4 |
| MA Al-10 wt % Ti-5 v/o SiC | 24 | 610 | 570 | 2.0 | 2.4 |
| | 93 | 540 | 514 | 2.0 | 4.7 |
| | 204 | 414 | 402 | 2.0 | 5.6 |

TABLE 4-continued

| Alloy/ Composite | Test Temperature (°C.) | Ultimate Tensile Strength (MPa) | Yield Strength (MPa) | Elongation (%) | Reduction in Area (%) |
|---|---|---|---|---|---|
| | 316 | 274 | 247 | 4.0 | 9.7 |
| | 427 | 152 | 148 | 8.0 | 21.1 |
| | 538 | 61 | 60 | 11.0 | 33.3 |
| MA Al-10 wt % Ti-15 v/o SiC | 24 | 626 | 569 | 2.0 | 1.6 |
| | 93 | 538 | 516 | 1.0 | 2.3 |
| | 204 | 423 | 390 | 2.0 | 1.9 |
| | 316 | 257 | 237 | 3.0 | 3.9 |
| | 427 | 143 | 136 | 4.0 | 9.3 |
| | 538 | 81 | 77 | 8.0 | 18.9 |

In general, the presence of SiC particles appears to cause a small increase in strength up to 316° C. to 427° C. However, the correlation of SiC content to strength at temperatures between 316° C. and 427° C. appears unclear. Addition of SiC reduces ductility at ambient temperatures, as is typical for Al-SiC composites, but does not degrade the ductility at elevated temperatures (greater than 427° C.). For this reason, the composites of the invention represent important engineering materials. These low density materials are likely to exhibit superior performance in applications requiring elevated temperature strength along with high stiffness levels at temperature. These materials should be particularly useful for aircraft applications above about 200° C. Modulus of elasticity at room temperature, determined by the method of S. Spinner et al., "A Method of Determining Mechanical Resonance Frequencies and for Calculating Elastic Modulus from the Frequencies," ASTM Proc. No. 61, pages 1221–1237, 1961, for alloys of the present invention are set forth in Table 5.

TABLE 5

| Alloy/Composite | Dynamic Modulus (GPa) | Calculated Modulus (GPa)* |
|---|---|---|
| MA Al-0Ti | 73.8 | 73.8 |
| MA Al-0Ti-5 v/o SiC | 84.8 | 87.6 |
| MA Al-0Ti-15 v/o SiC | 96.5 | 113.8 |
| MA Al-6 wt % Ti | 87.6 | 87.6 |
| MA Al-6 wt % Ti-5 v/o SiC | 95.2 | 100.0 |
| MA Al-6 wt % Ti-15 v/o SiC | 112.4 | 125.5 |
| MA Al-10 wt % Ti | 96.5 | 96.5 |
| MA Al-10 wt % Ti-5 v/o SiC | 105.5 | 108.9 |
| MA Al-10 wt % Ti-15 v/o SiC | 122.0 | 133.8 |

*Based on the rule of mixtures and assuming E for SiC = 345 GPa $E_c = E_s V_s + E_m V_m$ Where: E = modulus V = volume fraction
c = composite s = stiffener
m = matrix As illustrated in Table 5, the modulus increases with increased SiC content. Calculations show that the experimentally determined modulus of the composite to be increased to a level predicted by the rule of mixtures. The total modulus ranged from 89.6 to 96.9 percent of the total modulus predicted by the rule of mixtures. This is typical behavior of particulate composites which exhibit near iso-stress behavior.

The composite structure of the invention provides several advantages. The composite structure of the invention provides a metal matrix composite that has desirable bonding between the metal matrix and particle stiffeners. The metal matrix of the invention has exceptional retained ductility which is capable of accepting a number of particle stiffeners. With the alloy of the invention's high modulus, good wear resistance, low density, moderate ductility, low coefficient of thermal expansion and high temperature strength, the alloy has desirable engineering properties which are particularly advantageous at higher temperature. The alloy of the invention should prove particularly useful for lightweight aeronautical applications requiring stiffness and strength above 200° C.

While in accordance with the provisions of the statute, there is illustrated and described herein specific embodiments of the invention. Those skilled in the art will understand that changes may be made in the form of the invention covered by the claims and that advantage without a corresponding use of the other features.

The embodiments of the invention in which an exclusive property or privilege is claimed are defined as follows:

1. A composite aluminum-base alloy comprising:

a mechanically alloyed aluminum matrix alloy having about 4 to 40 percent by volume of an aluminum-containing intermetallic phase, said aluminum-containing intermetallic phase including at least one element selected from the group consisting of niobium, titanium and zirconium, said aluminum-containing intermetallic phase being essentially insoluble in said matrix alloy below one half the solidus temperature of said matrix alloy and having the balance of said matrix alloy principally being aluminum; and a composite stiffener distributed within said matrix alloy, said stiffener being from about 5 to 30 percent by volume of said composite aluminum-base alloy.

2. The alloy of claim 1 wherein said matrix alloy contains between 18 and 40 volume percent $Al_3Ti$.

3. The alloy of claim 1 wherein said matrix alloy contains between 4 and 18 volume percent $Al_3Ti$.

4. The alloy of claim 1 wherein said composite stiffener is selected from the group selected of $Al_2O_3$, Be, BeO, $B_4C$, BN, C, MgO, SiC, $Si_3N$, $TiB_2$, TiC, TiN, W, WC, $Y_2O_3$, $ZrB_2$, ZrC and $ZrO_2$.

5. The alloy of claim 1 wherein said composite stiffener is SiC particles.

6. The alloy of claim 1 wherein said composite aluminum-base alloy is used in an article of manufacture at temperatures above about 200° C.

7. The alloy of claim 1 wherein said matrix alloy has up to about 2 percent oxygen by weight and up to about 4 percent carbon by weight.

8. The alloy of claim 1 wherein said matrix is dispersion strengthened with about 0.1–2 percent oxygen by weight and about 1.0–4.0 percent carbon by weight.

9. A composite aluminum-base alloy comprising:

a mechanically alloyed aluminum matrix alloy having about 4 to 40 volume percent $Al_3Ti$, said $Al_3Ti$ being essentially insoluble in said matrix alloy below one half the solidus temperature of said matrix alloy, about 0.1 to 2 percent oxygen by weight and about 1 to 4 percent carbon by weight and having the balance of said matrix alloy principally being aluminum; and a silicon carbide particle composite stiffener distributed within said matrix alloy, said stiffener being about 5 to 30 percent by volume of said composite aluminum-base alloy.

10. The alloy of claim 9 wherein said silicon carbide particles are greater than 1 micrometer in average diameter.

11. The alloy of claim 9 wherein said composite aluminum base alloy is used in an article of manufacture at temperatures above about 200° C.

12. The alloy of claim 9 wherein said matrix alloy contains 18 to 40 volume percent $Al_3Ti$.

13. The alloy of claim 9 wherein said matrix alloy contains 4 to 18 volume percent $Al_3Ti$.

* * * * *